US005926933A

United States Patent [19]

Kaehr

[11] Patent Number: 5,926,933

[45] Date of Patent: Jul. 27, 1999

[54] METHOD OF LINING AN ANIMAL CARCASS INCINERATOR

[75] Inventor: Mark A. Kaehr, Decatur, Ind.

[73] Assignee: R & K Incinerator, Inc., Decatur, Ind.

[21] Appl. No.: 08/575,957

[22] Filed: Dec. 21, 1995

Related U.S. Application Data

[63] Continuation-in-part of application No. 08/373,584, Jan. 17, 1995, Pat. No. 5,699,745.

[51] Int. Cl.[6] ..... B23P 6/00

[52] U.S. Cl. ..... 29/402.08; 29/402.03; 29/426.1; 110/336

[58] Field of Search ..... 110/194, 235, 110/242, 336, 338; 432/248, 252; 29/402.03, 402.08, 426.1

[56] References Cited

U.S. PATENT DOCUMENTS

| | | | |
|---|---|---|---|
| 1,677,784 | 7/1928 | Kemp . | |
| 1,742,868 | 1/1930 | Mann . | |
| 2,074,874 | 3/1937 | Vogel | 110/336 |
| 2,684,842 | 7/1954 | Crespi et al. | 432/252 |
| 2,925,054 | 2/1960 | Sherman . | |
| 3,001,487 | 9/1961 | Meyer . | |
| 3,176,634 | 4/1965 | Martin . | |
| 3,177,827 | 4/1965 | Melvin . | |
| 3,246,442 | 4/1966 | Sauer | 110/336 |
| 3,362,887 | 1/1968 | Rodgers | 201/21 |
| 3,508,505 | 4/1970 | Gatewood . | |
| 3,557,726 | 1/1971 | Montgomery . | |
| 3,643,610 | 2/1972 | Bycroft . | |
| 3,651,771 | 3/1972 | Eberle . | |
| 3,680,500 | 8/1972 | Pryor . | |
| 3,768,424 | 10/1973 | Hage . | |
| 3,771,468 | 11/1973 | Kelly . | |
| 3,782,301 | 1/1974 | Livengood . | |
| 3,792,671 | 2/1974 | Woods . | |
| 3,808,985 | 5/1974 | Raber . | |
| 3,861,330 | 1/1975 | Santoleri . | |
| 3,892,396 | 7/1975 | Monaghan | 266/286 |
| 3,896,745 | 7/1975 | Mainka . | |
| 3,937,154 | 2/1976 | Hughes, Jr. . | |
| 4,000,705 | 1/1977 | Raber . | |
| 4,051,561 | 10/1977 | Frankel . | |
| 4,392,816 | 7/1983 | Berlie | 431/202 |

(List continued on next page.)

OTHER PUBLICATIONS

AP Green Refractory Pocket Catalog, Mar. 1992, pp. 20, 25–27, 46–51, 64, 83–97.

"High Temperature Alloys for Long–Term Service in Chemical Process Industry Applications", M.F. Rothman, et al, Werkstoffe und Korrosion, vol. 40, Issue 5, pp. 267–271 (1981).

"Performance of Alloys 825 and 625 in Waste Incinerator Environments", Gaylor D. Smith, et al. Materials Performance, vol. 28, No. 12, pp. 41–43 (1989).

"Spool Corrosion Tests in Wet Scrubber Systems", David B. Anderson, Materials Performance, vol. 20, Issue 10, pp. 13–18 (1981).

Burn–up for Waste Stoving–Oven Gases Also Recovers Heat, Anon., Process Engineering, p. 11 (Jun., 1977).

Brochure by State Line Equipment, Inc., date is believed to be 1995.

Brochure by State Line Agri., Inc. (Date of Publication is Believed to be 1993 or Before).

*Primary Examiner*—David P. Bryant
*Attorney, Agent, or Firm*—Baker & Daniels

[57] ABSTRACT

The present invention provides an incinerator for the disposal of animal carcasses and a method of lining such incinerators. The incinerator is provided with an access port which enables the interior of the incinerator to be easily lined with insulated refractory blocks. The incinerator may have a horizontal cylindrical housing with an access port at one end. The cylindrical housing is lined with arcuate-shaped refractory blocks which are introduced into the incinerator through the access port. The incinerator also includes a charge opening through which animal carcasses are loaded into the incinerator. A charge door, which is insulated with a fibrous insulation, is

11 Claims, 4 Drawing Sheets

U.S. PATENT DOCUMENTS

| | | | |
|---|---|---|---|
| 4,440,098 | 4/1984 | Adams | 110/215 |
| 4,483,256 | 11/1984 | Brashear | 110/210 |
| 4,503,784 | 3/1985 | Turecek | 110/176 |
| 4,583,469 | 4/1986 | Disabatino | 110/346 |
| 4,900,249 | 2/1990 | McCollum et al. | 110/336 |
| 4,910,063 | 3/1990 | Holland | 428/99 |
| 5,117,604 | 6/1992 | Bly et al. | 110/336 |
| 5,170,724 | 12/1992 | Mogi | 110/235 |
| 5,189,963 | 3/1993 | Mann | 110/190 |
| 5,237,938 | 8/1993 | Fujimori et al. . | |
| 5,245,936 | 9/1993 | Nakata | 110/251 |
| 5,339,752 | 8/1994 | Lewis | 110/194 |
| 5,363,777 | 11/1994 | Yoshimoto | 110/214 |

METHOD OF LINING AN ANIMAL CARCASS INCINERATOR

This is a continuation-in-part application based upon U.S. application Ser. No. 08/373,584 filed Jan. 17, 1995 now U.S. Pat. No. 5,699,745.

BACKGROUND OF THE INVENTION

1. Field of the Invention

The field of the invention relates to small incinerators for disposing of animal carcasses.

2. Description of the Related Art

Incinerators are well known in the art, and are used to dispose of a variety of materials. For example, incinerators are used for disposing of hazardous waste, waste gases, garbage and other refuse, such as sewage sludge and scrap tires. Incinerators range in size from small batch-fired incinerators to large mechanically fired industrial incinerators. In some large incinerators, the waste product is moved through the furnace on traveling grates so that combustion conditions are made nearly uniform over the waste product. Other large incinerators employ inclined reciprocating grates, drum grates, rocking grates and rotating kilns to provide agitation of the burning refuse.

Incinerators for animal carcasses are generally of the small batch-fired type. They are particularly useful to farmers for disposing of dead poultry and livestock. In animal carcass incinerators, factors such as cost and fuel efficiency are very important. Unlike the very expensive large industrial-type incinerators, animal carcass incinerators sell for only a few thousand dollars. Accordingly, cost factors are very important in the design of animal carcass incinerators.

Animal incinerators generally comprise an incineration chamber, a burner which produces a flame directly into the chamber, and an exhaust or smoke stack extending upwardly from the top of the incineration chamber. The shell of the chamber generally comprises a steel material. The steel shell may be lined with a high temperature insulating material, such as refractory cement or firebrick.

U.S. Pat. No. 3,176,634 proposes a typical incinerator for farm use. This incinerator comprises a shell lined with firebrick and includes a stainless steel grate for supporting the waste product. A burner is positioned to produce a flame in the chamber beneath the grate. An afterburner is disposed near the top of the incinerator for reducing or eliminating combustible products in the exhaust gases.

Other types of lined incinerators have been proposed. For example, U.S. Pat. No. 3,177,827 proposes an incinerator having an outer steel casing and a stainless steel liner spaced from the casing and extending around the sides of the casing. A W-shaped grate is secured within the chamber, and a burner is provided to produce a flame beneath the grate.

U.S. Pat. No. 3,508,505 proposes an animal carcass incinerator having a refractory lining in which the burner is positioned at the same end of the chamber as the exhaust stack. The draft of the flame from the burner forces the combustion products to travel around the far end of the grate, back beneath the grate, and then up and around the opposite end of the grate and out the exhaust stack.

SUMMARY OF THE INVENTION

The present invention, in one form thereof, provides an insulated and durable animal carcass incinerator with an easily replaceable and repairable refractory block-lined interior.

The invention comprises, in one form thereof, a carbon steel cylindrical housing which is circumferentially lined with insulated refractory blocks. The insulated refractory blocks are cast in an arcuate shape so that they are self-supporting and provide a durable, insulating liner. An access portal is provided in the housing which enables the user of the incinerator to easily and inexpensively repair or replace the insulated liner.

An advantage of the present invention is that repairing or replacing the liner is relatively easy and inexpensive. The present invention permits the selective replacement of individually damaged blocks, whereas damage to a lining formed by a monolithic pour is far more difficult to repair or replace. Moreover, the pouring of a monolithic interior lining is not easily accomplished by the user, typically a farmer, of the animal carcass incinerator. Whereas the partial or entire replacement of a refractory block liner in a housing having an access port is readily accomplished by the user of the animal carcass incinerator thereby saving both material and labor costs.

Another advantage of the present invention is the arcuate shape of the refractory blocks which allows them to be self-supporting. The arcuate shape of the blocks allows the upper half of the cylindrical incinerator interior to be lined without the extensive use of expensive retaining devices or the masonry skills required to create a self-supporting arch out of rectangular fire bricks.

Another advantage is the relatively high insulating values of the refractory blocks. By insulating the incinerator with refractory blocks fuel savings can be realized.

Another advantage of the present invention is the durability of an incinerator employing a refractory block-lined interior. The refractory blocks are more durable than most forms of insulating materials, such as fibrous insulation which requires the use of a more durable material to overlay at least part of the fibrous insulation to line the bottom of the incinerator.

The durability of the blocks is due not only to the material used to form the blocks but also the spaces between adjacent refractory blocks. The spaces between the blocks provide thermal expansion joints thereby making the blocks less likely to crack than a monolithic poured interior lining of the same material. The refractory blocks are also more durable and have a longer operating life than a stainless steel or carbon steel interior.

The use of insulated refractory blocks also prolongs the life of the outer shell of the incinerator which is thereby subject to less heat stress. Reducing the temperatures to which the incinerator shell is subjected also enhances the ability of the shell to retain an exterior coat of paint and thereby retards the formation of rust.

In a second embodiment of the invention, a heat sensor and controller unit are provided with the insulated refractory blocks. The heat sensor and controller monitor the temperature of the combustion chamber. When the temperature reaches a predetermined upper limit, fuel is no longer supplied to the burner. Only when the combustion chamber falls below a second, lower, predetermined temperature is the burner once again supplied with fuel. The careful regulation of the combustion chamber temperature produces a more efficient and cleaner burn than is obtainable without the heat sensor and controller.

The present invention, in yet another form thereof, provides a method for lining an animal carcass incinerator with refractory blocks. The cap which covers the access port of the incinerator is removed from the port. If present, a prior refractory block liner can then be removed through the access port. Once the interior of the housing has been emptied, the new liner can be installed. The arcuate shaped refractory blocks are slid into place through the access port. When the liner is complete the cap is secured in place.

An advantage of the present invention is that it allows the liner to be easily installed, replaced or repaired by the user of the incinerator relatively inexpensively and without the use of specialized equipment.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
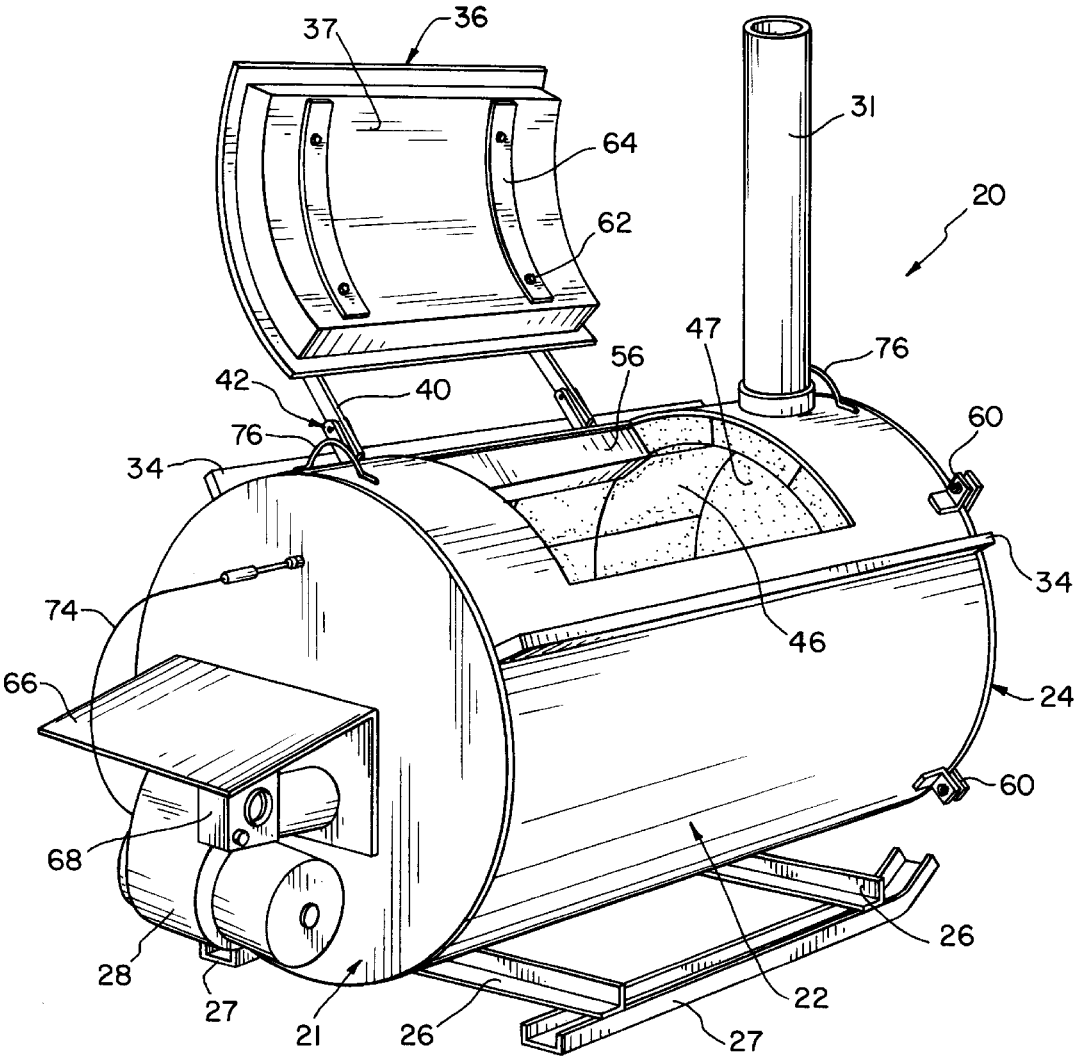
FIG. 1 is a perspective view of an incinerator in accordance with an embodiment of the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, in several forms, and such exemplifications are not to be construed as limiting the scope of the invention in any manner.

DESCRIPTION OF THE PRESENT INVENTION

The embodiments disclosed below are not intended to be exhaustive or limit the invention to the precise forms disclosed in the following detailed description. Rather, the embodiments are chosen and described so that others skilled in the art may utilize their teachings.

Referring to FIG. 1, there is shown an incinerator 20 in accordance with one embodiment of the present invention. Specifically, incinerator 20 comprises a cylindrical exterior shell or housing 22 attached to supports 26 and skids 27, a burner 28 disposed at one end of the housing 22 and an exhaust stack 31 disposed at a second and opposite end of the housing 22. A charge opening 32 is provided in housing 22 to permit animal carcasses to be charged into the incineration chamber. Housing 22 also includes reinforcing ribs 34.

Figure 2:
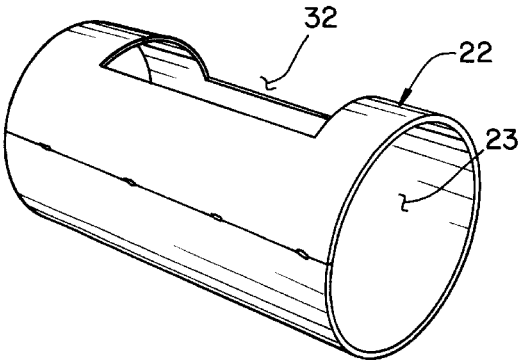
FIG. 2 is a perspective view of the exterior housing.

As shown in FIG. 2, housing 22 is preferably formed from an open ended ⅜" carbon steel pipe (52 AISI steel). Two openings are cut in the pipe to form a charge opening 32 and a vent opening (not shown in FIG. 2). The vent opening allows exhaust gases to be discharged from the combustion chamber into the exhaust stack 31. The exterior of the housing 22 is preferably painted for the protection thereby afforded against rain and snow. The skids 27 permit the incinerator 20 to be dragged along the ground, for example, by a tractor with a chain or rope attached to steel rod handle 76.

Figure 4:
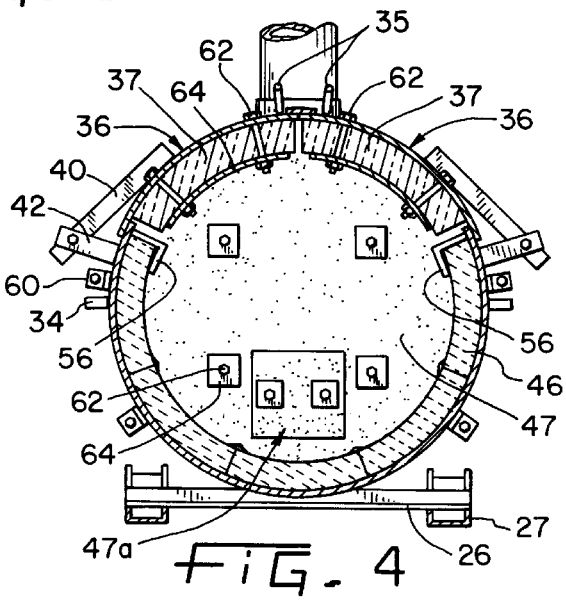
FIG. 4 is a cross-sectional view of an incinerator in accordance with an embodiment of the present invention.
Figure 3:
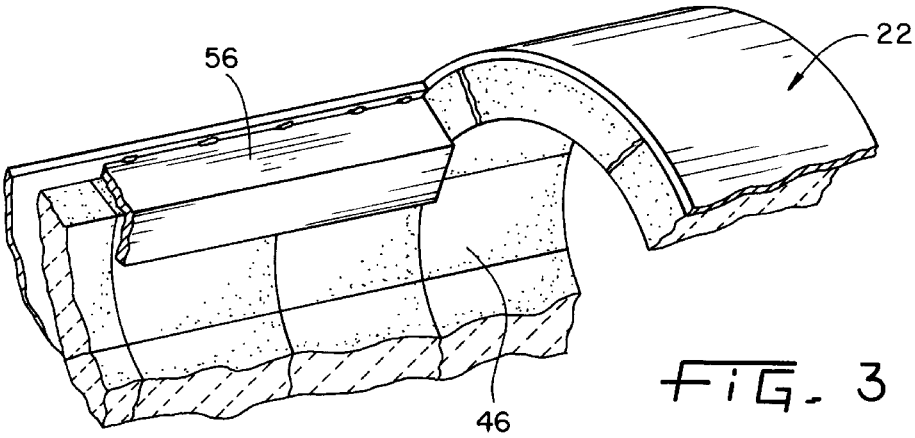
FIG. 3 is a partial view of the charge opening.

Hinges are used to mount a charge door 36 to the housing 22. The charge door 36 is movable between a closed position (FIG. 5) and an open position (FIG. 1). The incinerator 20 may have either one (FIGS. 1 and 5) or two (FIG. 4) charge doors 36. For incinerators having two charge doors 36, the doors are placed across from each other such that their outermost edges overlap along a longitudinal line running along the top of the housing 22.

Figure 5:
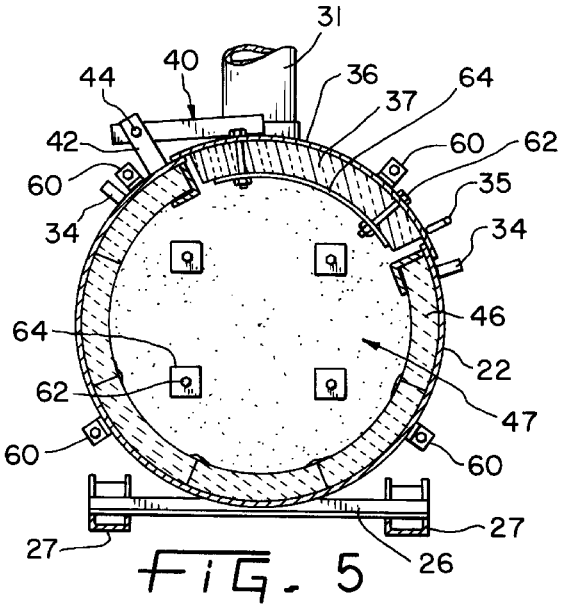
FIG. 5 is a cross-sectional view of an incinerator in accordance with the embodiment shown in FIG. 1.

The door may be mounted using any number of different methods including the assembly shown in FIGS. 1 and 5. As shown in FIG. 5, the hinge assembly includes a center hinge bracket 40 welded to the charge door 36 and two smaller hinge brackets 42 (only one of which is shown) welded to the housing 22. The center hinge bracket 40 is inserted between the two smaller hinge brackets 42 and a rod 44, which can consist of a bolt, is inserted between all three brackets to form a hinge. A stop can be placed between the two smaller hinge brackets 42 or on the larger hinge bracket 40 to prevent the charge door 36 from rotating beyond the upright position shown in FIG. 1. Without a stop, the charge door 36 may be rotated until it contacts housing 22. Also furnished is a door handle 35 fashioned from a steel rod and welded to the charge door 36.

Refractory blocks 46 are used to insulate the interior of the housing 22. The blocks 46 are manufactured using a castable, insulated refractory material such as Greencast® 45-L, a 45% alumina, high strength and low density material, commercially available from A.P. Green Industries, Inc., headquartered in Mexico, Miss.

Figure 12:
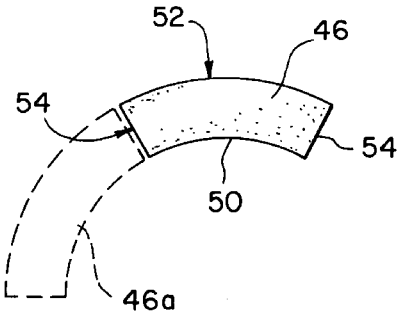
FIG. 12 is an end view of a refractory block and a ghost outline of an adjacent refractory block.
Figure 13:
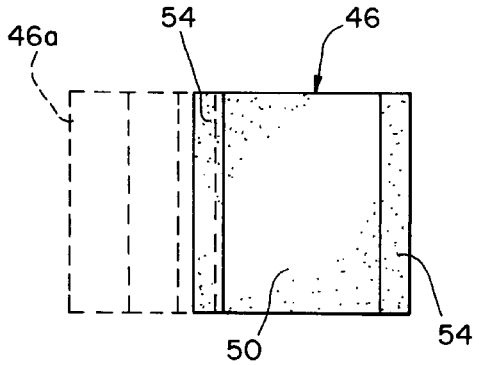
FIG. 13 is a longitudinal view of a refractory block and a ghost outline of an adjacent refractory block.

The blocks 46 are cast in an arcuate shape to conform to the interior cylindrical surface of housing 22. As best shown in FIG. 12, the arcuate blocks 46 have an inner curved surface 50 and an outer curved surface 52 and two slanted edges 54. The inner and outer curved surfaces 52 and 54 form arcs about a common center and slanted edges 54 are defined by radial lines extending from the same common center. The circumference of the circle, of which outer curved surface 54 defines a portion, has a diameter slightly less than the interior diameter of housing 22. As shown by the dashed outline of an arcuate block 46*a*, when the slanted edges 54 of adjacent arcuate blocks 46 are placed together the blocks form a continuing arc.

Prior to use in the incinerator the blocks should be prefired. The initial heating of the blocks should be controlled with the temperature being raised in a slow and deliberate manner to remove all of the moisture from the blocks prior to the formation of a seal on the block's exterior surface. For example, the blocks may be heated so that the temperature is increased 100° F. per hour until the temperature reaches 250° F., maintaining the temperature at 250° F.

for two hours, increasing the temperature at 100° F. per hour until the temperature reaches 500° F., maintaining the temperature at 500° F. for two hours, increasing the temperature at 100° F. per hour until the temperature reaches 800° F. and maintaining the temperature at 800° F. for two hours. After maintaining the temperature at 800° F. for two hours the furnace, and blocks therein, are allowed to slowly cool for 15 hours before the furnace is opened. If the blocks are not pre-fired the surface of the blocks may be sealed when the blocks are first subjected to high temperatures and before all of the water contained within the blocks is burned off. If the surface is sealed before the water is burned off, the water will be trapped and the blocks will be destroyed when the water expands during subsequent heating of the blocks.

When the arcuate blocks 46 are used to line the entire inner circumference of the housing 22 the blocks 46 form a self-supporting structure. Steel members having an L-shaped cross-section (i.e., angle irons) 56 are welded to the longitudinal sides of the charge opening 32 to provide support to blocks 46 which are adjacent to the charge opening 32. The blocks 46 adjacent to the charge opening could be bolted to the housing 22 instead of using the angle irons 56. The use of angle irons 56 is preferable, however, due to the protection the angle irons afford the blocks against impact by objects being loaded into the incinerator. The angle irons 56 may be easily replaced, if required, by welding new cross-sections into place. Appropriate welding equipment is typically owned and used by the owners of poultry and pig operations who can readily replace angle irons 56.

The cylindrical housing 22 has two circular ends, one of which has a permanently attached end plate 21 preferably consisting of a ⅜" circular steel plate welded to the housing 22. The end plate 21 has two holes through which the burner 28 and heat sensor 30 can be introduced into the combustion chamber of the incinerator 20. The other end of the housing 22 is not permanently sealed and forms an access port 23 through which refractory blocks 46 and disk-shaped refractory blocks 47 can be introduced or removed from the housing 22 interior. An end cap 24, preferably consisting of a circular ⅜" steel plate, is detachably secured to the housing 22 to close the access port 23. Brackets 60 are attached to the end cap 24 and the housing 22. Each of the brackets 60 have a hole through which a bolt may be passed to secure the brackets 60 on the end cap 24 to the brackets 60 located on the housing 22, thereby securing the end cap 24 to the housing 22.

The end plate 21 and end cap 23 are both lined with a large disk-shaped refractory block 47. The disk-shaped blocks 47 can either extend across the entire interior diameter of the housing 22 or across the interior diameter of the blocks 46. Holes are cut into the disk-shaped block 47 which lines end plate 21 to permit the burner 28 and heat sensor 30 to extend into the combustion chamber of the incinerator. The disk-shaped block 47 which lines end cap 23 is preferably bolted to the end cap 23 using stainless steel bolts 62 and retaining straps 64. Bolts 62 and retaining straps 64 can also be used to fasten a refractory block 47*a* cut from the disk-shaped block 47 to a clean-out door located on the end cap 23. The clean-out door can be constructed of ⅜" steel and is attached to the end cap with hinges and a latch. The clean-out door facilitates the removal of ashes from the incineration chamber. A clean-out door is not required and the ashes can be removed through the charge opening 32.

Figure 14:
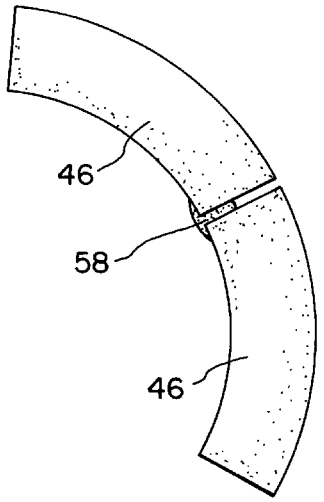
FIG. 14 is an end view of two adjacent refractory blocks and high temperature mortar.

High temperature mortar 58 consisting of similar material used to manufacture the blocks 46 may be used to form a surface layer between the blocks 46 lining the incinerator housing 22 as shown in FIG. 14. One suitable mortar is 'Sairset® which is a high temperature, air-setting bonding mortar available from A.P. Green Industries, Inc., headquartered in Mexico, Miss. High temperature mortar 58 is not required between the joints of adjacent blocks 46 although applying a small amount to fill a joint only near the surface of the block helps prevent ash from being deposited in the joint while still allowing for the thermal expansion of the blocks 46. High temperature mortar 58 may also be used to repair damaged blocks 46.

A fibrous insulating material 37 may be used to line the charge door 36. Preferably, the insulating material 37 is a ceramic fibrous material. One example of such a material is sold under the tradename Insulfrax, commercially available from The Carborundum Company, Niagara Falls, N.Y. This material is made from calcium, magnesium, silica chemistry, and a typical chemical analysis is as follows:

| | |
|---|---|
| $SiO_2$ | 65% |
| CaO | 31.1% |
| MgO | 3.2% |
| $Al_2O_3$ | 0.3% |
| $Fe_2O_3$ | 0.3% |

The thickness of the fibrous insulation material 37 can be varied as desired. For example, a thickness roughly equivalent to the thickness of the refractory blocks may be used. Other types of fibrous insulation may also be used, such as a ceramic fibrous material sold under the tradename CERWOOL, commercially available from Refractory Engineering, Inc., Indianapolis, Ind.

The fibrous insulation material 37 is secured to the interior surface of the charge door 36 by use of stainless steel retaining straps 64 and bolts 62. Although it is possible to fasten refractory blocks 46 to the interior of the charge door 36, the use of fibrous insulation material 37 greatly reduces the weight of the door. Additionally, either fibrous insulating material 37 or high temperature mortar 58 may be placed around the burner 28 and heat sensor 30 where they penetrate the housing 22 and disk-shaped refractory disk 47.

Figure 6:
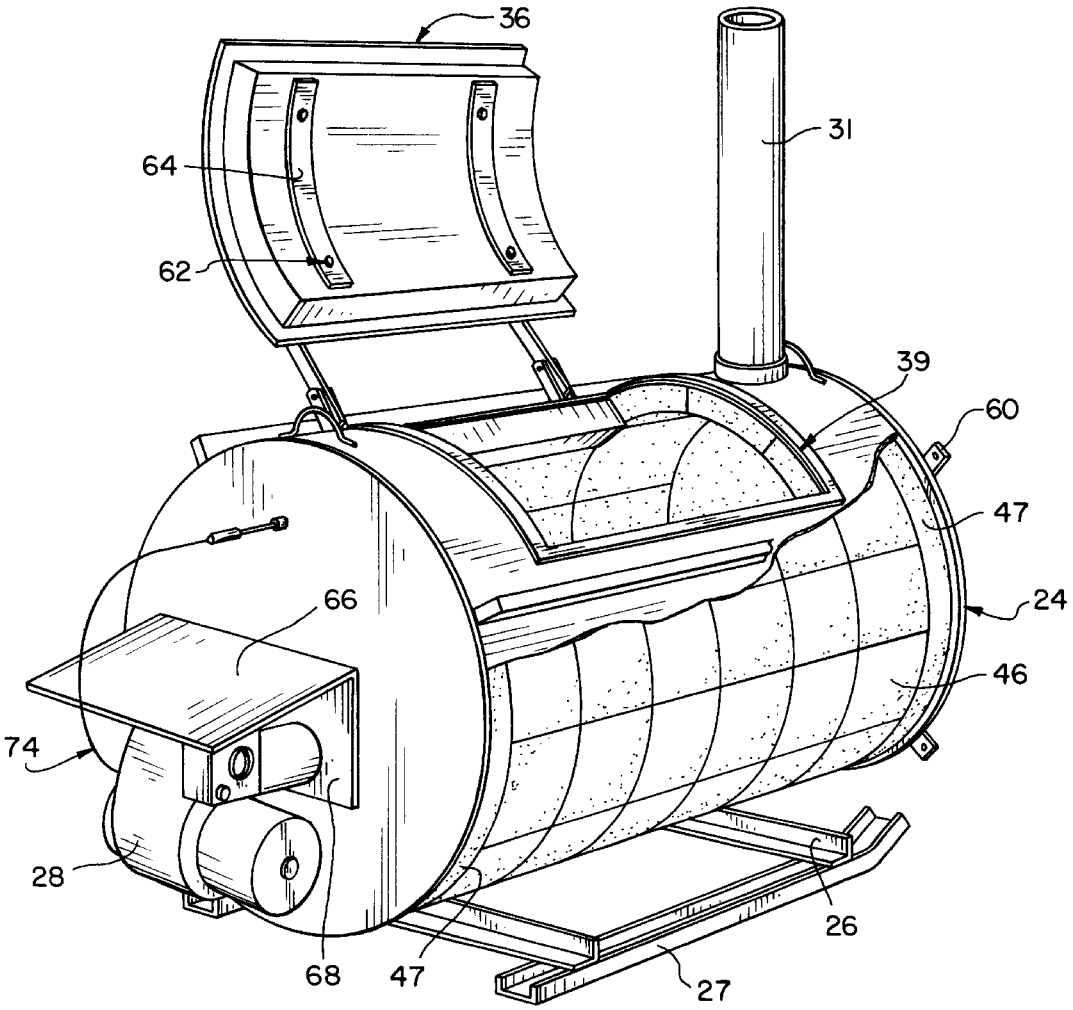
FIG. 6 is a perspective view of an incinerator with a partial cut-away of the exterior housing.

As shown in FIG. 6, an insulative strip 39 can be disposed about charge opening 32 to seal the gap between charge door 36 and housing 22 and prevent the escape of heated air during incineration. The insulative strip 39 is preferably made of ceramic fibers and is configured into the shape of a rope. A suitable ceramic fibrous rope is a alumina-silica rope commercially available from the Carborundum Company under the tradename Fiberfrax®. The insulative strip 39 may be secured to the housing 22 in any suitable manner, such as by bolting or gluing.

A burner 28 is provided at one end of the incinerator to produce a flame within the combustion chamber. Burner 28 is preferably of the type suitable for use in small incinerators. An example of a satisfactory model is the burner commercially available under the tradename EHA from Wayne Home Equipment Company, Inc., Fort Wayne, Ind. Further details of this type of burner are disclosed in U.S. Pat. No. 4,000,705, which is expressly incorporated herein by reference. The burner 28 is attached to the housing 22 with bolts or other suitable means.

A weather guard 66 is used to provide protection to the burner 28 and controller 29. The weather guard 66 is formed of a thin metal sheet of galvalium, or other common sheet metal material such as those used to form ductwork, and has a lower attachment flap 67 an upper flap 68. The lower attachment flap 67 has an orifice through which the burner nozzle is inserted and the weather guard 66 is secured by bolting the attachment flap 67 to the burner 28 or using another suitable means of attachment. The upper flap 68 shields the burner 28 and controller 29 from rain and snow thereby preventing weather damage.

Another feature of the present invention is the control mechanism for controlling the burner based upon the temperature in the incinerator. In one embodiment, the incinerator includes a controller 29 and a heat sensor 30. A K-type thermocouple heat probe may be utilized because such a probe can withstand temperatures up to 2500° F. A suitable controller is the Cal 3200 Autotune Temperature Controller, commercially available from CAL Controls Inc., Libertyville, Ill., however, combinations of other controllers and heat sensors can also be used.

Figure 8:
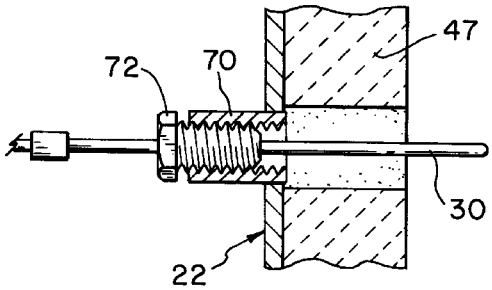
FIG. 8 is a view of a heat sensor.
Figure 7:
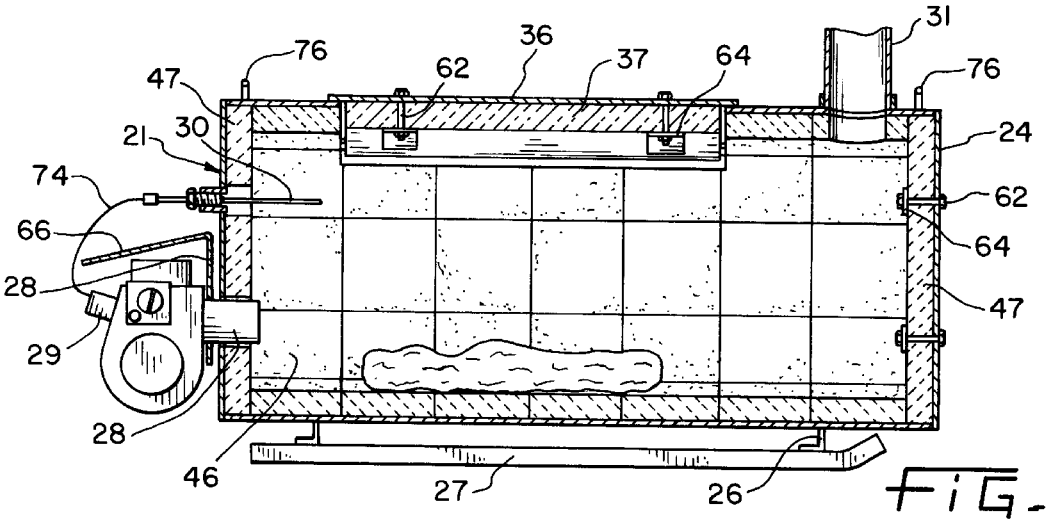
FIG. 7 is a longitudinal cross-section of an incinerator in accordance with the embodiment shown in FIG. 1.
Figure 9:
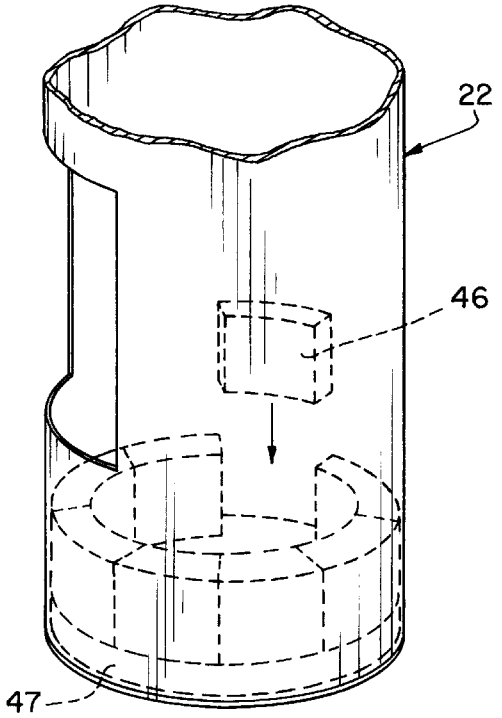
FIG. 9 is a diagrammatic view of refractory blocks being installed in the exterior housing.
Figure 10:
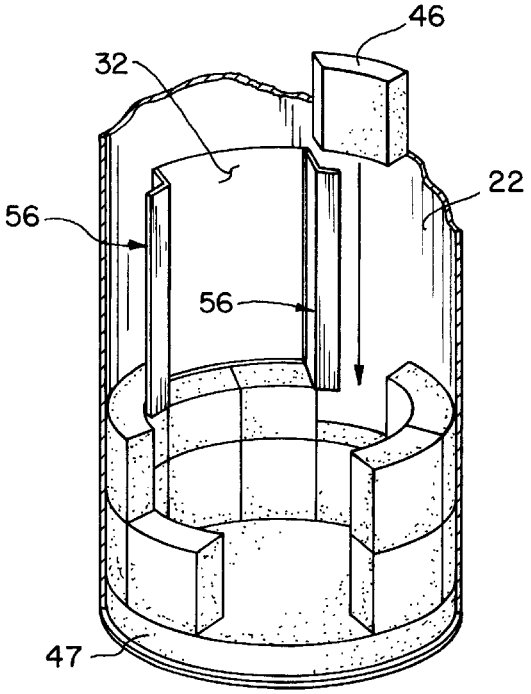
FIG. 10 is a further diagrammatic view of refractory blocks being installed in the exterior housing.
Figure 11:
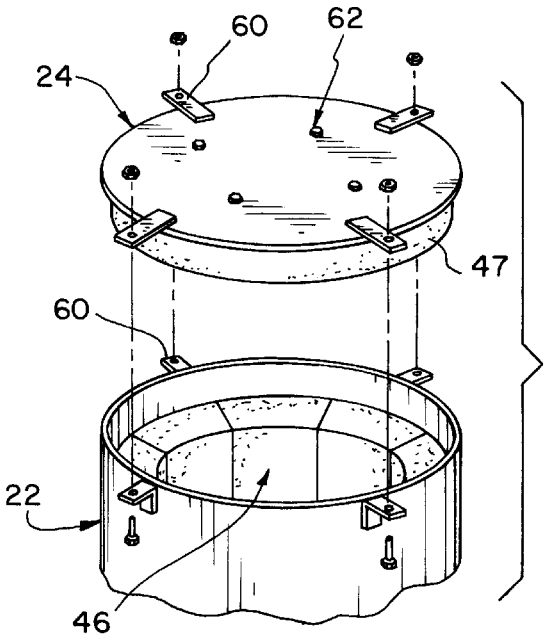
FIG. 11 is an exploded view of the exterior housing and end cap.

The heat sensor 30 may be placed at any location within the combustion chamber. In the disclosed embodiment, heat sensor 30 is placed inside the combustion chamber adjacent the burner 28. As shown in FIGS. 8 and 9, an internally threaded compression fitting 70, also known as a nipple, is welded or threaded within an opening in end plate 21. An externally threaded compression screw 72 is threaded into nipple 70. The heat sensor 30 securely fits within compression screw 72 so that the user can thread heat sensor 30 into and out of the combustion chamber as desired. The heat sensor 30 is electrically connected to controller 29 by line 74. Controller 29 is connected to the fuel valve in a conventional manner so that the controller 29 can monitor and adjust the amount of fuel that is combusted, thereby adjusting the heat within the chamber. For example, if the heat sensor 30 senses that the temperature of the combustion chamber reaches 1250° F., the controller 29 can be programmed to shut off the fuel valve. Thus, only air will be forced into the chamber at this point by the burner fan which continues to run. Once the temperature reaches a fixed value, for example 1100° F., the fuel valve again opens until the chamber reaches 1250° F. By allowing air to continually enter the chamber, there is sufficient oxygen to allow the carcass to burn even when the fuel valve is closed. These temperatures are provided for illustrative purposes only. It has been found that adequate combustion can occur with a temperature as low as 900° F.

The temperature controlled process achieves two advantages over time controlled processes. First, the temperature of the chamber is well controlled. A problem with time-based controllers is that the BTU content of the waste charge always varies. Thus, a time-based control system results in a great variation of temperatures, depending on the BTU output of the charge. In the temperature controlled process, the temperature of the chamber is constantly being monitored so that a controlled burning takes place. A controlled burning is important to assure minimal smoking and noxious waste emission. An insulated incinerator which does not utilize a controller may become too hot. The excess heat increases the rate of burn and the amount of oxygen supplied may be insufficient for the increased burn rate, leading to the discharge of uncombusted materials.

Second, the temperature controlled process results in greater fuel savings. The fuel savings occur because the controller stops supplying fuel to the burner when the carcasses are supplying the necessary BTU content to maintain an acceptable temperature and burn rate. Even greater energy savings can be realized by placing the carcasses on a grate within the incinerator. The grate may be constructed of a high temperature steel, stainless steel or other suitable material as is well known in the art.

Additionally, use of a temperature probe and controller allows a relatively small diameter exhaust stack 31, e.g., 4½ inches, to be used on the incinerator 20. Without a controller a small exhaust stack can result in an overly rapid combustion rate thereby leading to the discharge of uncombusted materials. Reducing the diameter of the exhaust stack 31 in combination with the use of a heat sensor 30 and controller 29, however, allows the flow rate of exhaust gases to be reduced and the retention time of the air introduced into the incinerator to be prolonged. The increased retention time reduces the amount of heat which escapes from the incinerator 20 through exhaust stack 31 thereby further increasing the fuel efficiency of the incinerator. Such small diameter exhaust stacks may create a static back pressure whereby the pressure within the combustion chamber exceeds the ambient atmospheric pressure which surrounds the incinerator.

Control of the burn rate is also enhanced by relying upon the burner fan for introducing air into the incinerator rather than utilizing a larger diameter exhaust stack and one or more air holes in the incinerator housing for allowing fresh air into the combustion chamber.

The present invention also features a method of lining an animal carcass incinerator 20. The first step is to remove the end cap 24. If there is an old lining within the incinerator 20 which is being replaced it must then be removed. The old lining may be removed and replaced either partially or entirely. If the entire lining is removed, a disk-shaped block 47 is then inserted into the housing 22 through the access port 23 or charge opening 32. Prior to insertion into the housing 22, two holes are cut into the disk-shaped block 47, one each for the burner 28 and heat sensor 30. If the disk-shaped block 47 extends across the entire inner diameter of the housing 22 the first course of arcuate blocks 46 will retain the disk-shaped block 47 in place. If the disk-shaped block only extends across the inner diameter of the arcuate blocks 46, the first course of arcuate blocks 46 must be placed prior to the disk 47 and retaining straps 64 and bolts 62 may be required to hold the disk-shaped block 47 in place.

The refractory material used to construct the disk-shaped and arcuate blocks 47 and 46 can be readily worked using common masonry tools such as a wet saw, a hand-held circular saw with a masonry blade, or a drill with an appropriate masonry or concrete drill bit. Thus, the operator of the incinerator can typically replace the lining individually without having to hire a third party. Arcuate refractory blocks 46 are then used to line the interior of the housing 22. For each course of arcuate blocks 46, the last block must be slid into place in the longitudinal direction and may have to be cut to fit properly. For those courses which abut the charge opening 32, arcuate blocks 46 must be slid into engagement with angle irons 56. For many of the courses the blocks can be introduced into the housing 22 through either the charge opening 32 or access port 23, however, it is more convenient to introduce the last course of arcuate blocks 46 in a longitudinal direction through the access port 23. The incinerator 20 may also be configured such that the charge opening 32 and charge door 36 also function as the access port 23 and access cap 24, respectively.

A layer of high temperature mortar 58 is then placed between the disk-shaped block 47 and burner 28 and heat sensor 30 where the disk is penetrated. A thin layer of high temperature mortar 58 may also be placed on the surface of the joints between adjoining blocks or to repair any damaged blocks. The final step involves fastening a disk-shaped block 47 to the end cap 24 using stainless steel bolts and straps 62 and 64 and bolting the end cap 24 to the housing 22. If a clean-out door is present in the end cap 24, a portion of the disk-shaped block 47 must be cut from the disk and attached to the clean-out door prior to attaching the end cap 24 to the housing 22.

Preferably, the housing 22 is tipped on its end so that it rests upon the end plate 21 prior to installation of the lining. This simplifies the installation of the arcuate blocks 46. The housing 22 is easily tipped on its end, after removal of the burner 28, controller 29 and heat sensor 30, by attaching a chain to the steel rod handle 76 located on the housing 22 and lifting one end of the housing 22 by the chain with a lift commonly found on tractors.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A method of lining an animal carcass incinerator housing wherein said housing is cylindrical and has a cylindrical inner surface having a substantially circular cross-section, said method comprising:

providing an access port in said housing and a cap disposed over said access port;

removing said cap from said access port;

inserting a plurality of tapered refractory blocks through said access port to line substantially all of said housing cylindrical inner surface, at least some of said refractory blocks interlocking with each other when inserted by virtue of their tapered shapes; and securing said cap over said access port.

2. The method of claim 1 further comprising the step of removing a pre-existing lining from the interior of said housing after removing said cap from said access port.

3. The method of claim 1 further comprising the step of insulating a charge door located on the housing with a fibrous insulation.

4. The method of claim 1 wherein said steps are performed at a location where the incinerator has been previously used to combust animal carcasses.

5. The method of claim 1 wherein said housing has a substantially horizontal axis.

6. The method of claim 5 further comprising the steps of removing a burner and tipping the incinerator so that the housing axis is substantially vertical with said access port located on the upper end of the incinerator prior to removing said cap;

placing the housing axis in a substantially horizontal orientation after securing said cap over said access port; and reattaching the burner to the incinerator.

7. The method of claim 5 further comprising the step of fastening a disk-shaped refractory block to said cap prior to securing said cap over said access port.

8. The method of claim 5 wherein said housing has a horizontal axis in use and said access port is disposed on one end of said housing.

9. The method of claim 8 and further comprising the steps of tipping the incinerator so that the housing so that the housing axis is substantially vertical with the access port located on the upper end thereof, and performing the step of inserting the refractory blocks while the incinerator is substantially vertical.

10. A method of lining an animal carcass incinerator housing, wherein said incinerator housing is cylindrical and has a horizontal axis in use, said method comprising:

providing an access port on an end of the housing and a cap disposed over the access port;

upwardly tipping the incinerator on end such that said axis is substantially vertical and the access port is located on the upper end;

removing the cap from the access port;

while the incinerator is on end, inserting a plurality of refractory blocks through the access port to line substantially all of an inner surface of said cylindrical housing;

securing the cap over the access port; and downwardly tipping the incinerator to its use position with said axis substantially horizontal.

11. The method of claim 10 wherein the refractory blocks are tapered and have curved inner and outer surfaces, and at least some of the blocks interlock with each other during insertion into the housing by virtue of their tapered shapes.

* * * * *